US007600974B2

(12) United States Patent
Svensson et al.

(10) Patent No.: US 7,600,974 B2
(45) Date of Patent: Oct. 13, 2009

(54) RADIAL BLADE WHEEL

(75) Inventors: Rune Svensson, Huskvarna (SE); Jan-Erik Henningsson, Huskvarna (SE); Lennart Sjöqvist, Huskvarna (SE); Juha Laurila, Tampere (FI); Heikki Stenberg, Nousiainen (FI)

(73) Assignee: Flaekt Woods AB, Joenkoeping (SE)

( * ) Notice: Subject to any disclaimer, the term of this patent is extended or adjusted under 35 U.S.C. 154(b) by 481 days.

(21) Appl. No.: 11/357,112

(22) Filed: Feb. 21, 2006

(65) Prior Publication Data

US 2006/0222500 A1 Oct. 5, 2006

(30) Foreign Application Priority Data

Feb. 21, 2005 (FI) ..... 20055079

(51) Int. Cl.
*F04D 29/38* (2006.01)

(52) U.S. Cl. ..... 416/183; 416/228

(58) Field of Classification Search ..... 416/183, 416/185, 186 R, 187, 223 B, 235, 237, 228, 416/DIG. 2
See application file for complete search history.

(56) References Cited

U.S. PATENT DOCUMENTS 1,577,110 A * 3/1926 Collins ..... 415/174.3
3,272,429 A * 9/1966 Wood ..... 416/186 R
6,039,539 A * 3/2000 Berg ..... 416/186 R
6,929,452 B1 * 8/2005 Pargeter et al. ..... 416/186 R
7,179,050 B2 * 2/2007 Hopfensperger ..... 415/204
2005/0025619 A1 2/2005 Chang et al.

FOREIGN PATENT DOCUMENTS

EP 0 616 131 A1 1/1994
GB 659389 10/1951

OTHER PUBLICATIONS

English Translation of Chinese Office Action dated Jan. 21, 2009.

* cited by examiner

*Primary Examiner*—Edward Look
*Assistant Examiner*—Dwayne J White
(74) *Attorney, Agent, or Firm*—Buchanan Ingersoll & Rooney PC

(57) ABSTRACT

The present invention relates to a radial blade wheel (1) with blades (3), a first wall (2) connected with the blades and having an opening (4) for enabling a flow through the wall (2) to the blades (3), and a second wall (5) connected with the blades (3), by which the radial blade wheel (1) may be connected with an apparatus rotating it. To achieve a higher efficiency, the protrusion of the blades (3) in the radial direction diminishes at intervals from the first wall (2) towards the second wall (3).

8 Claims, 1 Drawing Sheet

RADIAL BLADE WHEEL

FIELD OF THE INVENTION

The present invention relates to a radial blade wheel applicable in fans.

DESCRIPTION OF THE PRIOR ART

There is known a radial blade wheel which comprises a first wall connected with blades and having an opening for enabling a flow through the opening to the radial blade wheel and further out of discharge openings between the blades. By means of a second wall connected with the blades, the radial blade wheel may be connected with an apparatus rotating it, such as an electric motor.

The performance and efficiency of the radial blade wheel are affected by a plurality of factors. Prior art radial blade wheels have provided solutions, in which the performance and efficiency of the radial blade wheel are as high as possible. In known solutions, however, the efficiency has not reached a totally satisfying level.

SUMMARY OF THE INVENTION

It is an object of the present invention to provide a radial blade wheel whose efficiency is higher than in prior art radial blade wheels. This object is achieved by a radial blade wheel in accordance with the independent claim 1.

The invention utilizes a solution, in which the protrusion of the blades in the radial direction diminishes at intervals from the first wall towards the second wall. With this kind of structure it is possible to prevent that the pressure is different at different points of the blade tips. With a radial protrusion whose size changes at intervals, the pressure at different points of the blade tips may be affected in such a manner that an optimal efficiency is achieved.

The preferred embodiments of the radial blade wheel of the invention are disclosed in the attached dependent claims 2 to 10.

BRIEF DESCRIPTION OF THE FIGURES

The invention is described in the following by way of example in greater detail and with reference to the attached figures, in which.

DESCRIPTION OF SOME EMBODIMENTS

Figure 1:
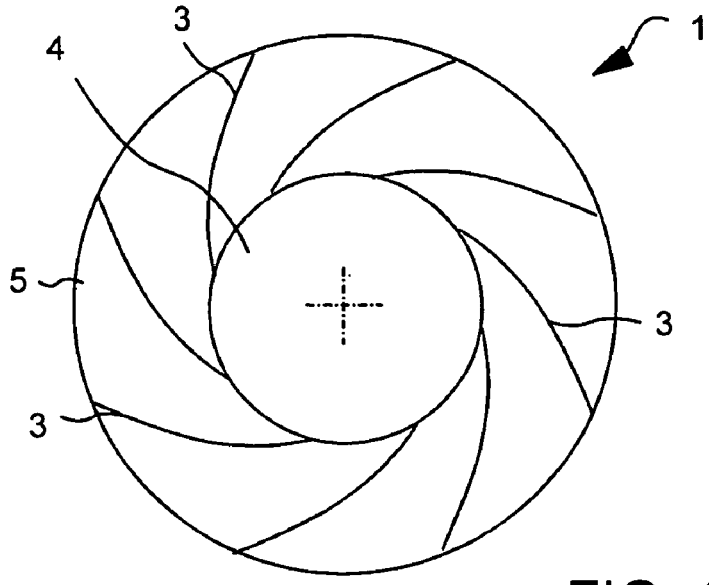
FIG. 1 shows a partially sectional front view of a first preferred embodiment of a radial blade wheel of the invention.
Figure 2:
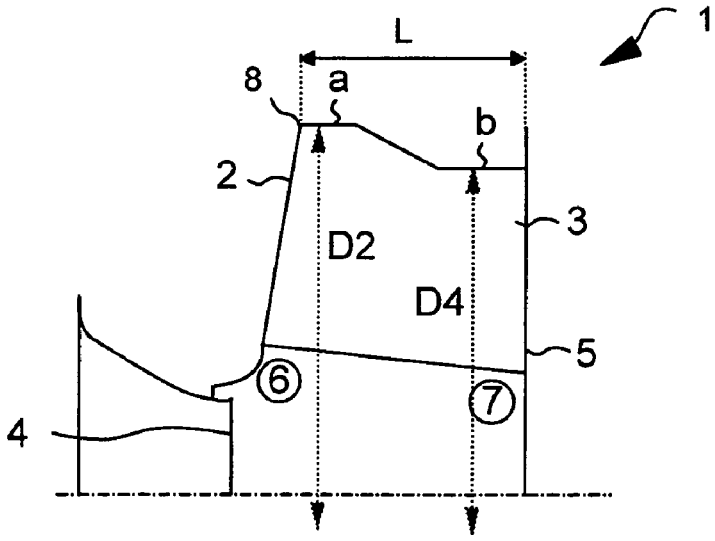
FIG. 2 shows a partially sectional side view of the radial blade wheel of FIG. 1.

FIGS. 1 and 2 show partially sectional views of a first preferred embodiment of a radial blade wheel of the invention. The radial blade wheel 1 shown in the figures may be utilized as an enclosed wheel or without a specific casing. FIG. 1 shows a front view of the radial blade wheel without a first wall 2, FIG. 2 shows it as a sectional view from the side.

The radial blade wheel 1 comprises a first wall 2 connected with blades 3. The first wall is provided with an opening 4 enabling a flow through the first wall to the radial blade wheel 1. From the radial blade wheel 1, the flow continues further through discharge openings between the blades 3 under the influence of rotational motion of the wheel. The radial blade wheel 1 is connected via a second wall 5 connected with the blades 3 to an apparatus, such as an electric motor, rotating the radial blade wheel.

In connection with the present invention it has been discovered that along the inner edges of the blades there is a different static pressure distribution. It was found out in a measurement that the underpressure at a measurement point 6 closer to the inlet opening 4 of FIG. 2 was 170 Pa, whereas the underpressure at a measurement point 7 further away from the inlet opening 4 was 30 Pa. In order to achieve the highest possible efficiency for the radial blade wheel, the pressure difference is compensated in the embodiment of FIG. 2 in such a manner that the protrusion of the blades 3 in the radial direction diminishes at intervals from the first wall 2 towards the second wall 3. In this way, the same end pressure may be achieved at the outer tips of the blades along the entire length L of the blade.

In the exemplary embodiment of FIG. 2, the blade comprises a first section a, which has the same radial protrusion along the entire section. This is followed by a step where the radial protrusion of the blade diminishes in size in such a manner that a second section b has the same radial protrusion along the entire section. By dimensioning the lengths of the sections a and b suitably and providing a suitable radial protrusion at these sections, it is possible to affect the pressure distribution along the outer tip of the blade.

On the basis of the experiments conducted, the efficiency of the radial blade wheel is at its best when the length of the section a is about 15 to 35% of the distance L between the first and the second wall. In this case, the distance L is measured along the blade tip of the first section (i.e. parallel to the rotational axis of the radial blade wheel at the outer tip 8 of the first wall in FIG. 2). The distance L thus corresponds to the width of the discharge opening between the blades 3. The best end result was achieved when a was 22% of the distance L.

The best efficiency measured in a similar manner was achieved when the length of the section b was about 42 to 50% of the distance L. The best end result was achieved when b was 46% of the distance L.

The radial protrusion of the blades 3, i.e. the diameter D2 of the radial blade wheel at point a as well as D4 at point b, must be dimensioned on the basis of the experiments conducted in such a manner that the ratio of D2 to D4 is about 1.05 to 1.15. The best end result was achieved when the ratio of D2 to D4 was about 1.08.

FIG. 2 shows that the second wall 5 protrudes in the radial direction further than the blade tips at point b, but the first wall 2 does not protrude in the radial direction further than the blade tips at point a. This is one alternative embodiment. According to the invention it is also possible that the protrusions of both the first and the second wall are bigger in the radial direction than the protrusions of the blades in their vicinity or, vice versa, that none of the walls protrudes radially further than the blades in their vicinity.

It is to be understood that the above description and the related figures are only intended to illustrate the present invention. Different variations and alterations of the invention will be obvious to a person skilled in the art without departing from the scope of the invention.

The invention claimed is:

1. A radial blade wheel, comprising:

blades;

a first wall connected with the blades and having an opening for enabling a flow through the wall to the blades; and a second wall connected with the blades, by which the radial blade wheel may be connected with an apparatus configured to rotate the radial blade wheel; and wherein the blades protrude in a radial direction to a diameter which diminishes at intervals from the first wall towards the second wall such that a diameter of the blades at the first wall is larger than a diameter of the blades at the second wall; and wherein the blades comprise, in the vicinity of the first wall, a first section where the radial protrusion of the blades remains unchanged towards the second wall, and the blades comprise, in the vicinity of the second wall, a second section where the radial protrusion of the blades remains unchanged towards the first wall.

2. A radial blade wheel as claimed in claim 1, wherein the a protrusion of the blades in the radial direction at points where they are connected with the second wall is smaller than the protrusion of the second wall in the radial direction.

3. A radial blade wheel as claimed in claim 1, wherein the length of the first section is about 15 to 35% of the distance between the first and the second wall, measured along the tip of the blade of the first section.

4. A radial blade wheel as claimed in claim 1, wherein the length of the first section is about 22% of the distance between the first and the second wall, measured along the tip of the blade of the first section.

5. A radial blade wheel as claimed in claim 1, wherein the length of the second section is about 42 to 50% of the distance between the first and the second wall, measured along the tip of the blade of the first section.

6. A radial blade wheel as claimed in claim 1, wherein the length of the second section is about 46% of the distance between the first and the second wall, measured along the tip of the blade of the first section.

7. A radial blade wheel as claimed in claim 1, wherein when the diameter of the radial blade wheel is D2 at the first section and D4 at the second section, the ratio of D2 to D4 is about 1.05 to 1.15.

8. A radial blade wheel as claimed in claim 1, when the diameter of the radial blade wheel is D2 at the first section and D4 at the second section, the ratio of D2 to D4 is about 1.08.

* * * * *